United States Patent [19]

Amancharla

[11] 3,980,134

[45] Sept. 14, 1976

[54] WELL PACKER WITH FRANGIBLE CLOSURE

[75] Inventor: Amareswar Amancharla, Dallas, Tex.

[73] Assignee: Otis Engineering Corporation, Dallas, Tex.

[22] Filed: Apr. 7, 1975

[21] Appl. No.: 565,769

Related U.S. Application Data

[63] Continuation-in-part of Ser. No. 428,068, Dec. 26, 1973, abandoned.

[52] U.S. Cl. ..... 166/133; 166/224 R

[51] Int. Cl.[2] ..... E21B 33/12

[58] Field of Search ..... 166/188, 224, 164, 133

[56] References Cited

UNITED STATES PATENTS

| | | | |
|---|---|---|---|
| 2,545,504 | 3/1951 | Villafane | 166/224 |
| 2,565,731 | 8/1951 | Johnston | 166/224 |
| 2,865,454 | 12/1958 | Richards | 166/188 |
| 3,211,228 | 10/1965 | Bramlett | 166/133 |

*Primary Examiner*—James A. Leppink
*Attorney, Agent, or Firm*—H. Mathews Garland

[57] ABSTRACT

A device for converting a well packer to a bridge plug for closing off flow along a well bore to isolate adjacent portions of the well bore on opposite sides of the packer, including a tubular sub connectible on the lower end of a well packer and a frangible closure plate supported in sealed relationship in the sub across the bore of the packer for closing off flow through the packer. The frangible plate is installed in the packer at the surface prior to setting the packer in the well bore and thereafter is destroyed without removal of the packer from the well bore to establish communication through the packer. The plate is insulated against vibration, withstands high hydraulic loads from both sides while fragmenting responsive to very low mechanical loads, and expends in small pieces to give a full bore opening without obstruction.

13 Claims, 4 Drawing Figures

WELL PACKER WITH FRANGIBLE CLOSURE

This is a continuation-in-part of application Ser. No. 428,068 filed Dec. 26, 1973, entitled WELL TOOLS and now abandoned.

This invention relates to well tools and more particularly to bridge plugs for use in well bores.

In the drilling of wells, particularly for the production of petroleum oil and gas, it is frequently necessary to perform a number of different operations through a well bore. Such well processes are often carried out where it is necessary to isolate an adjacent zone of the well by temporarily closing off communication through the well bore between the zone treated and the zone being protected. For example, in testing, squeezing cement into a formation, performing well stimulation processes including introducing acids and other chemicals into the well bore, performing well fracturing operations, and a multitude of other well processes, it is desirable that the zone below the one being treated be isolated to protect it from damage. At least two forms of apparatus are currently available for converting a well packer to a bridge plug to isolate the two zones separated by the packer. One such device is referred to as an expendable sealing plug which is installed in a packer at the surface and after the well procedures are carried out, the plug is then expended to the bottom of the packer by a downward force from a stinger or sealing unit introduced into the packer from the surface. Such devices often do not hold against pressure from both above and below the tool. Also, such a plug may be easily expended downwardly against a high pressure below the tool. One tool which uses a fragmenting disc does not provide a full bore opening, requires a special hammer to break, and cannot be broken with small force. Further, such device does not break into small pieces and requires more force to break when a high pressure is below the plug. Other forms of devices for plugging a packer are retrievable when they have performed their function of closing the bore of the packer. Both the expendable and retrievable plugs currently available are mechanical devices having a number of parts which require movement to either expend or retrieve a plug, depending upon the type. Because of the mechanical actions required for the functioning of the plugs of both types, the devices are relatively expensive to manufacture, and, obviously, are subject to malfunction in a well bore. Any failure of a well to properly operate in a well bore can be quite expensive because of the time and equipment required for extra trips from the surface into the well which may be necessitated because of a device failure.

It is, therefore, a particularly important object of the invention to provide a new and improved means for temporarily plugging a well bore of a petroleum oil or gas well.

It is another object of the invention to provide new and improved means for temporarily converting a well packer to a bridge plug for closing off flow through a well bore.

It is another object of the invention to provide a combination well packer and a bridge plug device.

It is another object of the invention to provide bridge plug means in a well packer which is run with the packer for closing off flow through the well bore and thereafter is destroyed and expended into the well bore eliminating extra trips into the well required by some plug means.

It is a further object of the invention to provide a new and improved bridge plug for use with a well packer which is inexpensive to manufacture and install and employs no moving parts.

It is a still further object of the invention to provide a bridge plug for a well packer which uses a frangible closure plate for shutting off communication along the bore of the packer.

It is a still further object of the invention to provide an expendable plug for a well packer which uses a glass member for temporarily closing the bore of the packer.

It is another object of the invention to provide a bridge plug closure plate which is very highly brittle.

It is another object of the invention to provide a bridge plug having a glass closure plate mounted to isolate the plate from vibration.

It is another object of the invention to provide a glass bridge plug closure plate mounted to withstand high loads without concentrating high stresses in the glass.

It is another object of the invention to provide a glass bridge plug closure plate adapted to withstand high hydraulic pressures from either side while fragmenting into very small pieces responsive to very low mechanical loads.

It is another object of the invention to provide a ridge plug closure plate which fully fragments into very small pieces to provide a full bore opening through the device.

In accordance with the invention there is provided a bridge plug for a well packer which includes a sub connectible to the lower end of the mandrel of a well packer, a frangible closure plate supported in the sub closing off the bore in the packer, and seal means between the sub and the closure plate to provide a pressure-tight seal between the plate and sub.

The foregoing objects and advantages together with the specific details of the invention will be better understood from the following detailed description of a preferred embodiment taken in conjunction with the drawings wherein.

Figure 3:
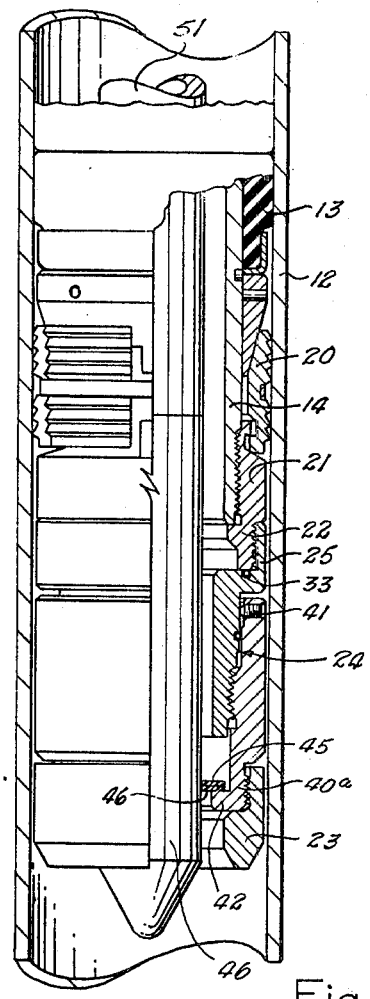
Figure 4:
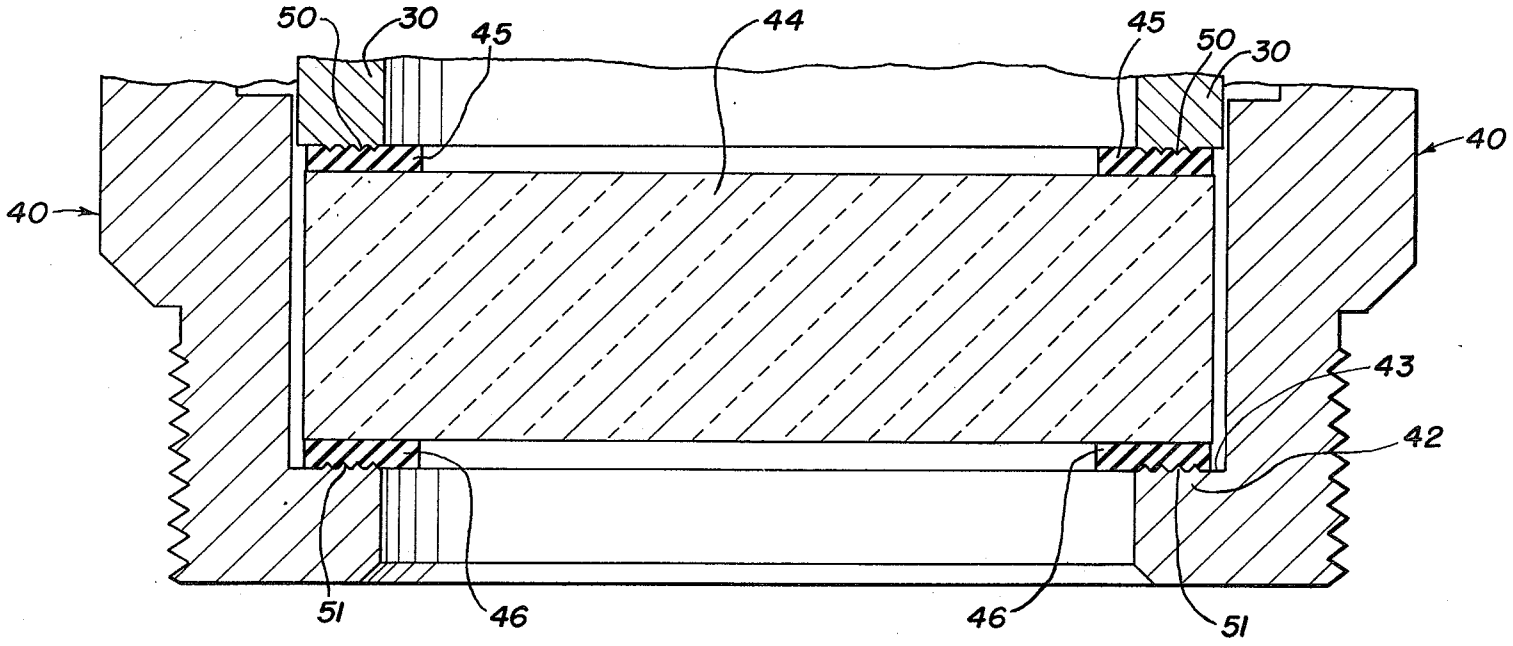

FIG. 3 is a fragmentary view in section and elevation illustrating the lower end of the packer and the bridge plug after destruction of the bridge plug and expending of the fragments downwardly in the well bore by a tool shown inserted through the packer and plug device; and FIG. 4 is an enlarged fragmentary view in section of the lower end portion of the bridge plug showing the closure plate mounting and seal details.

Figure 1:
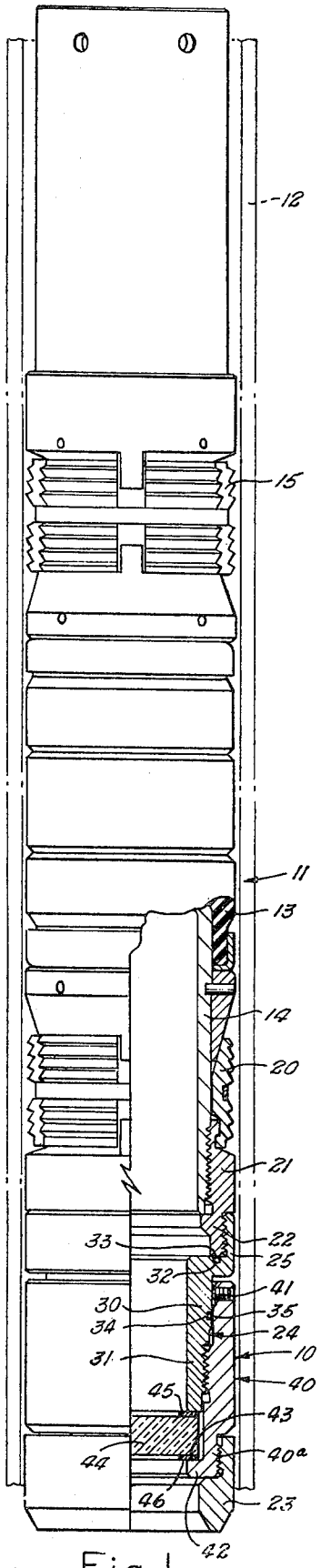
FIG. 1 is a longitudinal view in elevation and section showing a well packer fitted with a bridge plug embodying the features of the invention, illustrating the packer as run into the well prior to setting in the well bore.

Referring to FIG. 1 of the drawings, a bridge plug device 10 is illustrated connected on the lower end of an Otis Perma-Drill packer 11 being inserted into a casing 12 in a well bore. The Otis Perma-Drill packer which is illustrated and described in detail at page 3422 of the *Composite Catalog of Oilfield Equipment and Services*, 1972– 1973 *Edition*, published by World Oil, Houston, Tex., includes an expandable seal element 13 supported on a mandrel 14 between upper and lower slip assemblies 15 and 20, respectively. A lower slip retainer 21 is secured on the threaded lower end portion of the mandrel. The lower slip retainer is reduced and externally threaded along a lower end portion 22. The packer 11 normally includes an internally threaded guide shoe 23 which, as illustrated in the reference, is threaded on the lower end portion 22 of the lower slip retainer of the packer. When the packer is converted in accordance with the invention, the guide shoe is removed and the bridge plug assembly 10 is installed on the lower threaded end portion 22 of the lower slip retainer.

The bridge plug device 10 includes a tubular sub 24 which has an enlarged internally threaded upper end portion 25 and a main body portion 30 externally threaded along a lower end portion 31. The top end face of the sub body 30 has an upwardly opening annular recess 32 supporting an O-ring seal 33 confined in the recess against the lower end face of the packer slip retainer 21 for sealing between the sub and the slip retainer when the bridge plug device is installed on the packer. The body portion 30 of the sub 24 has an external annular recess 34 above the lower threaded end portion 31 in which an O-ring seal 35 is disposed for sealing between the body portion of the sub and a housing 40 threaded on the sub portion 31. A plurality of spaced socket-head set screws 41 threaded through the upper end of the housing engage the sub 30 above the ring seal 35 locking the housing on the sub. The housing 40 has an externally threaded reduced lower end portion 41 provided with an internal annular flange 42 having an upwardly facing stop shoulder 43. A frangible closure plate 44 is supported on the stop shoulder 43 clamped between an upper ring-shaped gasket 45 and a lower ring-shaped gasket 46. The upper gasket 45 engages the lower end face of the sub 30 while the lower gasket 46 rests on the upwardly facing stop shoulder 43. The gaskets 45 and 46 seal with the closure plate 44 providing a pressure-tight seal with the plate closing the bore through the packer. As shown in FIG. 4, the lower end edge surface of the sub portion 31 is provided with a serrated finish 50, while, similarly, the stop shoulder 43 has a serrated surface 51. The surfaces 50 and 51 may be formed by concentric circular lands and grooves or by spiral lands and grooves defining a "phonograph finish." The gaskets 45 and 46 support the closure plate 44 in a vibration insulted relationship so that mechanical vibrations to which the bridge plug is subjected do not affect the plate. The serrated finishes grip the gaskets to sustain high hydraulic pressures above and below the plate without extruding the gaskets. Further, the plate is supported between the gaskets without concentrating high stresses in the glass. The gaskets permit bending of the glass responsive to hydraulic loads so that the glass stresses are not so concentrated that the glass breaks under the static loading applied by the member 40 necessary to effect seals sufficient to retain the hydraulic pressure to which each side of the plate may be subjected. The guide shoe 23 of the packer is threaded on the lower end of the housing 40 to function in the conventional manner for guiding the packer along the well bore as it is lowered into a well.

In accordance with the invention the frangible closure plate 44 is formed of a suitable brittle glass which is fractured and expended downwardly from the housing through the guide shoe to drop harmlessly to the bottom of a well. The glass is of a type which preferably completely shatters into very small pieces when struck a blow so that it will fragment sufficiently to fully open the bore through the packer. The glass must also withstand the pressure differentials used in the various well procedures carried out above the packer when the bridge plug is in place on the packer in a well bore. Such glass is tempered to develop high internal stresses which cause fragmentation when small mechanical loads are applied. A glass which has been found to meet the requirements of the invention is Corning Glass Works' "Pyrex" brand Code 7740. This material is a borosilicate glass tempered to about three times the annealed strength of the glass which induces a controlled compression at the glass surface. Tension applied to the glass by hydraulic pressure in the well bore is offset by the temper induced compression permitting the plate to withstand high hydraulic pressures which have been as high as 6000 psi on a plate having a 9 square inch area producing a total force on the plate of 54,000 pounds. The particular glass found acceptable for use in the invention was primarily designed for use as a sight glass for viewing into boiler fireboxes.

In operation, the bridge plug is assembled on a suitable packer by removing the packer guide shoe 23 from the lower slip retainer 21 and threading the bridge plug sub 30 on the threaded lower end portion 22 of the slip retainer. The guide shoe 23 is then secured on the lower end portion 41 of the housing 40. A packer such as the Otis Perma-Seal packer is thereby converted to a bridge plug in accordance with the invention.

Figure 2:
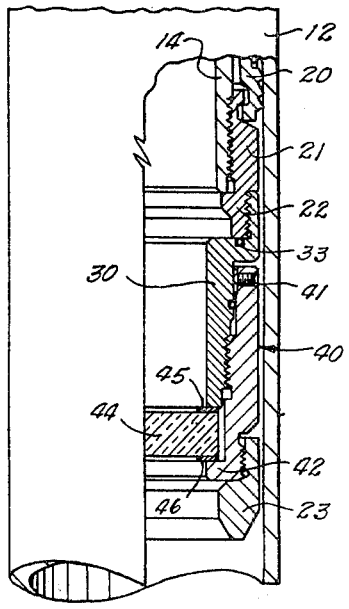
FIG. 2 is a fragmentary view in section and elevation showing the bridge plug and the lower end of the packer of FIG. 1 after the packer has been set in the well casing with the bridge plug closing off flow along the well bore.

After assembly of the bridge plug on the packer, the packer is lowered into a well bore in a conventional manner. When at the desired depth in the casing, the packer is set by expansion of the seal 13 and engagement of the upper and lower slips 15 and 20 with the inner wall surface of the casing 12. FIG. 2 illustrates the lower slips set in the casing at the desired depth with the bridge plug assembled on the packer so that the packer serves to isolate the well bore within the casing above the packer to permit various well treatments and other procedures to be carried out through the well bore above the packer without damage to any zone or zones communicating with the well bore through the casing below the packer. For example, well stimulation procedures may be carried out above the packer by injecting liquids such as various acids under pressure into the well bore for pumping into formations above the packer without exposing formations below the packer to the injected materials. Substantial hydraulic pressures may be applied in the well bore above the bridge plug for carrying out the desired well treatment procedures. As previously discussed, pressures as high as 6000 psi have been successfully applied in tests using the glass plate material identified above. Such pressure may be sustained by the bridge plug from either side of the plate so that the plug will contain well treatment fluid pressures above the plug and well fluids at such pressure below the plug. The nature of the glass plate mounting employed, together with character of the glass, permits the glass to bend in response to the high pressures imposed on it without localized stresses of sufficient value to fracture the glass. Additionally, the system used for the glass plate isolates the plate from mechanical vibration sufficiently that the bridge plug and packer with which it is connected are manipulated in a normal manner during the running and setting of the packer and bridge plug and carrying out of the desired well treatment procedures without special consideration having to be given to the presence of the glass plate and the well bore.

After the various desired procedures have been carried out in the well bore, the bridge plug permits reopening the well bore without removal of either the packer or any portion of the bridge plug to the surface and without activating or moving any mechanical parts as in conventional bridge plugs. As represented in FIG. 3, a pointed probe 52 may be secured on the lower end of a string of pipe 53 and lowered in the well bore through the casing against the closure plate 44. When the pointed lower end of the probe 52 strikes the plate 44, the plate shatters and the fragments fall from the housing 40 through the guide shoe bore into the well bore below the packer. While the upper gasket 45 above the plate 44 is represented in FIG. 3 as having dropped onto the lower gasket 46 after the plate 44 has been destroyed, it is probable that one or both of the gaskets may be carried downwardly in the well bore with the fragments of the plate.

The particular nature of the glass plate is to shatter or totally disintegrate into very minute pieces which results in a full opening through the bridge plug members 30 and 40 when the plate is subjected to a blow as from the probe 52. The instant and total disintegration of the plate expends the small fragments downwardly in the well bore so that the fragments do not interfere with further treatment steps in the well. The fragmentation is so thorough and the pieces are so small that any restrictions in the tubing below the packer are not obstructed.

Preferably, the plate 44 of the bridge plug is shattered by the lower end of a suitable seal unit, not shown, used to seal within the packer between a tubing string, not shown, and the packer. Such seal units are shown at page 3426 of the *Composite Catalog of Oilfield Equipment and Services*, supra. The selected sealing unit is secured on the lower end of a tubing string 53 which is then lowered through the casing in the well bore to be installed in the packer 11. As the sealing unit is landed in the packer, the plate 44 is simultaneously shattered by the lower end of the seal unit and expended into the well bore of the packer. By using the lower end of the seal unit to destroy the bridge plug, only a single trip into the well is necessary for installing the tubing string and re-establishing communication through the packer. Since there are no mechanical parts which must be moved or activated to expend the bridge plug so long as the lower end of the seal unit passes downwardly through the plug, there is no possibility of a failure or malfunction of the bridge plug.

There has been provided a simple, inexpensive form of bridge plug which is run with a packer and which is removed without extra trips into the well other than one required for installing a tubing string and the like. The absence of moving mechanical parts eliminates the possibility of a malfunction.

What is claimed is:

1. A bridge plug for use with a well packer to temporarily close a bore through said packer comprising: a sub connectible to the lower end of said packer; a housing connected on said sub, said sub and said housing having bores having collinear axes collinear with the axis of the bore of said well packer when said sub and housing are on said packer, said bores through said housing and said sub being substantially the same diameter as the said bore through said packer; a closure plate clamped between said sub and said housing across the bores therethrough, said closure plate comprising a material adapted to deflect responsive to high hydraulic pressures while holding said pressures from opposite sides thereof and to disintegrate into small pieces responsive to a low value mechanical impact; vibration insulation means on each side of said plate between said plate and said sub and housing; and a surface portion of each of said sub and said housing engaging said vibration insulation means being serrated to resist extrusion of said vibration insulation means responsive to hydraulic pressure.

2. A bridge plug in accordance with claim 1 wherein said plate comprises a tempered glass.

3. A bridge plug in accordance with claim 2 wherein said glass is a borosilicate glass tempered to about three times the annealed strength of said glass.

4. A bridge plug for use with a well packer to temporarily close the bore through said packer comprising: a tubular sub having an upper end portion adapted to thread onto a lower end portion of said packer, and said sub having a threaded lower end portion and a lower end edge surface having a serrated configuration defined by substantially circular lands and grooves; a tubular housing threaded on said lower end portion of said sub, said tubular housing having an internal annular flange having an annular stop shoulder facing the serrated end edge of said sub and spaced therefrom, said stop shoulder surface on said flange of said housing having a serrated surface defined by substantially circular lands and grooves; a closure plate clamped between said serrated end edge surface of said sub and said serrated stop shoulder surface of said housing, said closure plate being a material adapted to deflect responsive to hydraulic pressure from either side of said plate while holding substantial hydraulic pressure from either side of said plate and to disintegrate into substantially small pieces to fully open the bore through said housing and sub into said packer responsive to a low value mechanical impact; and vibration insulation means on each side of said closure plate between said closure plate and said serrated surfaces on said end edge of said sub and on said top surface on said flange of said housing.

5. A bridge plug in accordance with claim 4 wherein said closure plate is supported in a manner to distribute localized stresses caused by hydraulic pressure sufficiently to prevent disintegration of said plate responsive to said pressure.

6. A bridge plug in accordance with claim 4 wherein said closure plate comprises glass.

7. A bridge plug in accordance with claim 6 wherein said glass is a borosilicate glass tempered to about three times the annealed strength of said glass.

8. A bridge plug in accordance with claim 6 wherein said glass is tempered.

9. A well packer for temporarily closing a well tubing in a well bore comprising: a tubular body; means on said body for releasably locking said well packer with the inner wall surface of a well tubing; an expandable annular seal element on said packer for effecting a seal around said tubular body and the inner wall surface of well tubing; a tubular sub threaded on a lower end portion of said tubular body, said sub having a serrated lower end edge surface defined by a plurality of substantially circular lands and grooves; a tubular housing threaded on said sub, said housing having an internal annual flange provided with a stop shoulder facing and spaced from said serrated end edge on said sub, said stop shoulder having a serrated surface defined by substantially circular lands and grooves; a closure plate clamped between said stop shoulder on said housing and said serrated end edge surface of said sub for temporarily closing the bore through said packer, said closure plate being adapted to deflect responsive to hydraulic pressure from either side of said plate while holding said pressure and to totally disintegrate into small pieces responsive to a low value mechanical impact; and vibration insulation gaskets between said closure plate and said serrated end edge surface on said sub and said serrated stop shoulder surface on said housing annular flange.

10. A well packer in accordance with claim 9 wherein said closure plate is supported in a manner to minimize localized stresses in said plate responsive to said hydraulic pressure to prevent disintegration of said plate responsive to said hydraulic pressure.

11. A well packer in accordance with claim 9 wherein said closure plate comprises glass.

12. A well packer in accordance with claim 11 wherein said glass is a borosilicate glass tempered to about three times the annealed strength of said glass.

13. A well packer in accordance with claim 11 wherein said glass is tempered.

* * * * *

UNITED STATES PATENT OFFICE

CERTIFICATE OF CORRECTION

Patent No. 3,980,134 Dated September 14, 1976

Inventor(s) Amareswar Amancharla

It is certified that error appears in the above-identified patent and that said Letters Patent are hereby corrected as shown below:

Column 1, line 31, insert -- not -- after "may".
Column 2, line 25, "ridge" should read "bridge".

Signed and Sealed this

Twenty-first Day of December 1976

[SEAL]

*Attest:*

RUTH C. MASON
*Attesting Officer*

C. MARSHALL DANN
*Commissioner of Patents and Trademarks*